US006589026B2

(12) United States Patent
Fujiwara

(10) Patent No.: US 6,589,026 B2
(45) Date of Patent: Jul. 8, 2003

(54) FLUID MACHINERY HAVING A HELICAL MECHANISM WITH THROUGH HOLES FOR VENTILATION

(75) Inventor: Takayoshi Fujiwara, Yokohama (JP)

(73) Assignee: Toshiba Carrier Corporation, Tokyo (JP)

( * ) Notice: Subject to any disclaimer, the term of this patent is extended or adjusted under 35 U.S.C. 154(b) by 0 days.

(21) Appl. No.: 10/178,395

(22) Filed: Jun. 25, 2002

(65) Prior Publication Data

US 2002/0197177 A1 Dec. 26, 2002

(30) Foreign Application Priority Data

Jun. 25, 2001 (JP) ..... P2001-191916

(51) Int. Cl.[7] ..... F04B 39/06; F01C 1/344; F01C 21/06

(52) U.S. Cl. ..... 417/372; 417/410.5; 418/91; 418/101; 418/220

(58) Field of Search ..... 417/372, 410.5; 418/91, 101, 220

(56) References Cited

U.S. PATENT DOCUMENTS 3,180,569 A * 4/1965 Bielefeld ..... 418/101
5,174,737 A * 12/1992 Sakata et al. ..... 418/220

FOREIGN PATENT DOCUMENTS

JP 7-107391 11/1995
JP 11-107953 4/1999

* cited by examiner

*Primary Examiner*—John J. Vrablik
(74) *Attorney, Agent, or Firm*—Pillsbury Winthrop LLP

(57) ABSTRACT

A fluid machinery comprises a helical mechanism provided with a cylinder, a roller eccentrically disposed inside the cylinder and formed with a helical groove and a blade member fitted in the helical groove, an electric motor unit connected to the helical mechanism through a rotational shaft, the roller, which eccentrically rotates, having an engagement portion engaged with a crank portion of the rotational shaft, and a pair of bearings disposed to both axial end portions of the cylinder so as to support the rotational shaft. The engagement portion of the roller and the bearings are formed with through holes for ventilation, respectively.

12 Claims, 4 Drawing Sheets

FLUID MACHINERY HAVING A HELICAL MECHANISM WITH THROUGH HOLES FOR VENTILATION

BACKGROUND OF THE INVENTION

The present invention relates to a fluid machinery of a helical structure adapted to continuously deliver a fluid to be compressed in an axial direction thereof, and more particularly, relates to a fluid machinery provided with an air cooling system.

An indoor type air conditioner, a refrigerator, a freezing chamber such as freezing showcase or like is assembled with a freezing cycle or freezing system, and such freezing cycle is incorporated with a compressor for compressing a refrigerant or cooling medium. Such compressor includes a reciprocal type one or rotary type one, but in recent years, a helical type compressor utilizing a helical blade for a compressing mechanism has been developed.

One example including such helical type compressing mechanism is disclosed in Japanese Patent Laid-open (KOKAI) Publication HEI 11-132176, in which a lubricating oil for lubricating a sliding portion of the compressing mechanism is generally utilized for cooing a machinery chamber, motor or like.

However, for the purpose of using a freezing cycle utilizing the helical mechanism, it is not always desired to use the lubricating oil, and such requirement is not satisfied by the helical compressor disclosed in the above prior art publication. Hence, it has been desired to provide a fluid machinery having a compact structure capable of cooling the helical mechanism without utilizing any lubricating oil.

SUMMARY OF THE INVENTION

An object of the present invention is therefore to substantially eliminate defects or drawbacks encountered in the prior art mentioned above and to provide a fluid machinery, which comprises:

a helical mechanism provided with a cylinder, a roller eccentrically disposed inside the cylinder and formed with a helical groove and a blade member fitted in the helical groove;

an electric motor unit operatively connected to the helical mechanism through a rotational shaft so as to drive the helical mechanism, said roller, which eccentrically rotates, having an engagement portion engaged with a crank portion of the rotational shaft; and a pair of bearings disposed to both axial end portions of the cylinder so as to support the rotational shaft, the engagement portion of the roller and the bearings being formed with through holes for ventilation, respectively.

According to the fluid machinery of this aspect, the helical mechanism and the electric motor unit can be cooled by the air without utilizing lubricating oil or like cooling medium. Furthermore, the rotational shaft has a small eccentricity in comparison with the rotational shaft of a conventional reciprocal compressor, rotary compressor or like, so that the cylinder or like member can be made compact, thus providing a compact fluid machinery.

In preferred embodiments or examples of the above aspect, the fluid machinery further comprises a fan mounted to an axial end portion of the rotational shaft. The fan may be disposed on the side of the helical mechanism or on the side of the electric motor unit.

The cylinder is formed of an aluminium including material such as aluminium alloy.

The cylinder is provided, at an outer periphery thereof, with fins for heat radiation.

The helical groove has a pitch gradually reduced along an axial direction of the roller.

The helical groove has a pitch substantially equal along an axial direction of the roller.

The cylinder has an outer periphery to which fluid suction port and fluid exhaust port are formed for the fluid to be delivered by the helical mechanism.

The fluid machinery may further comprises a cylindrical case into which the helical mechanism and the electric motor unit are accommodated, the cylindrical case being provided with openings for ventilation formed to both axial end portions thereof.

The cylinder has an outer periphery secured to an inner periphery of the case so as to define a ventilation space therebetween. The outer periphery of the cylinder has a cross section of the shape substantially the same along an axial direction thereof.

According to such preferred embodiments, the location of the fan at the end portion of the rotational shaft allow the helical mechanism and the motor unit to be effectively cooled by air and to be aligned with the shaft, making possible to provide a compact structure of the fluid machinery.

Since the cylinder is formed from an aluminium including material, the heat radiation from the cylinder can be enhanced. This heat radiation will be further enhanced through the fins formed to the outer periphery of the cylinder.

Since the engagement portion of the roller of the helical mechanism and the main and counter bearings mounted on the rotational shaft to support the same are provided with the through holes for ventilation, the bearing, the roller and the helical blade of the helical mechanism can be effectively cooled.

Furthermore, in a case where the helical groove is formed to have a pitch gradually reduced along an axial direction of the roller, so that a small sized air-cooling helical compressor may be provided. Further, in a case where the helical groove has a pitch substantially equal along an axial direction of the roller, a small sized air-cooling helical pump may be provided.

Still furthermore, the fluid machinery may further comprises a cylindrical case into which the helical mechanism and the electric motor unit are accommodated with a space or gap therebetween, and the cylindrical case being is provided with openings for ventilation formed to both axial end portions thereof. In this example, the cylinder can be cooled more effectively.

The nature and further characteristic features of the present invention will be made more clear from the following descriptions made with reference to the accompanying drawings.

DESCRIPTION OF THE PREFERRED EMBODIMENT

Figure 1:
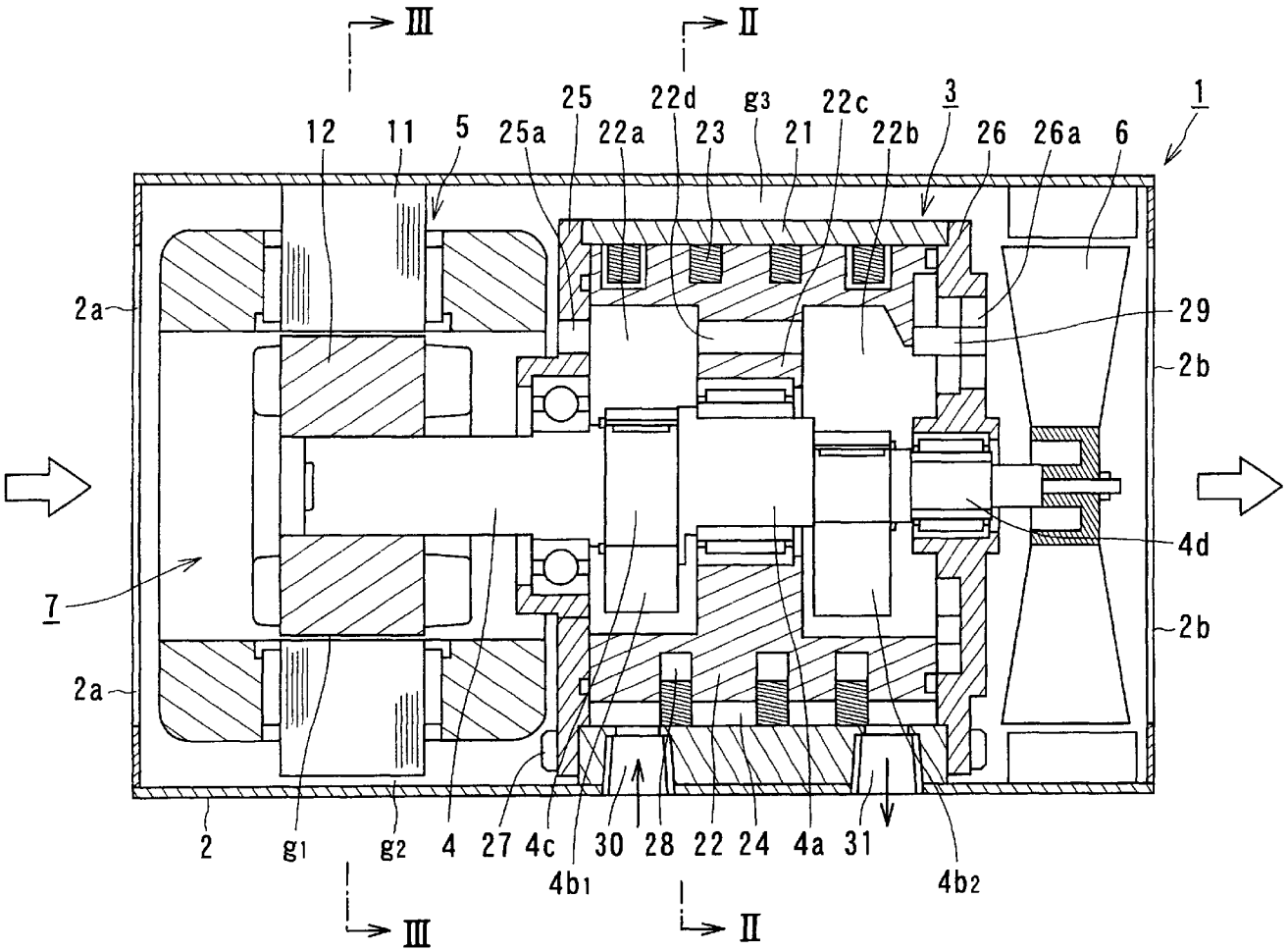
FIG. 1 is a sectional view of a fluid machinery according to a first embodiment of the present invention taken along the axial line thereof.
Figure 2:
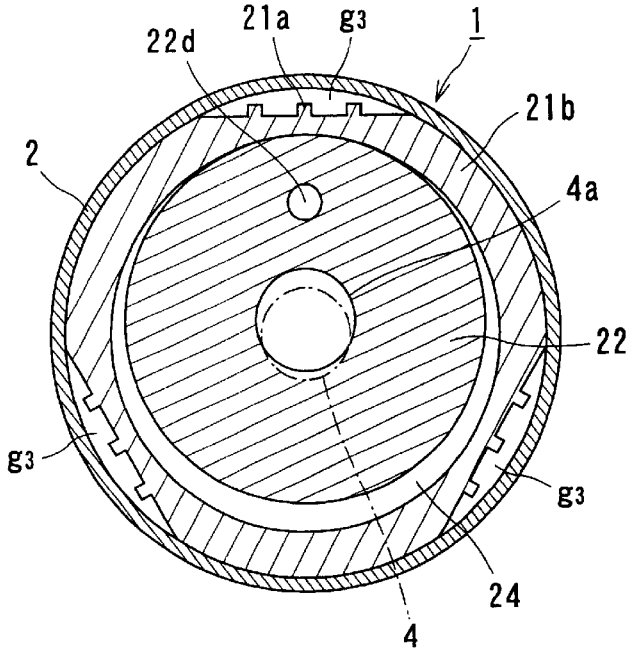
FIG. 2 is a sectional view taken along the line II—II in FIG. 1.
Figure 3:
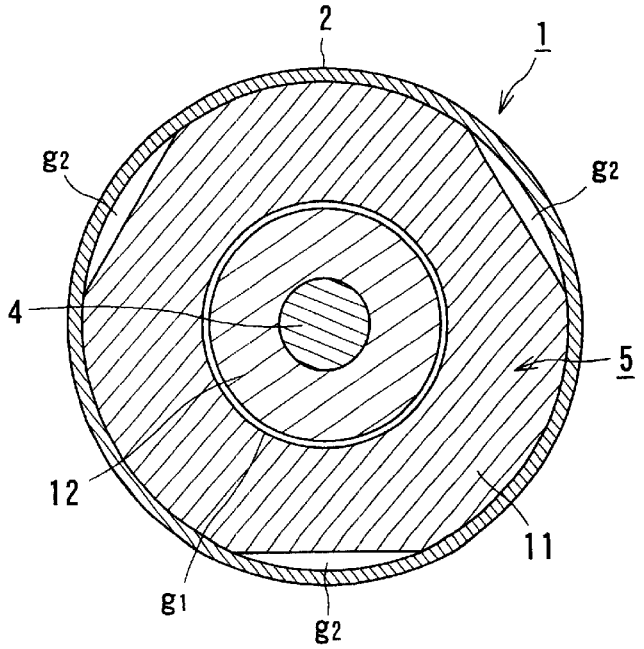
FIG. 3 is a sectional view taken along the line III—III in FIG. 1.

FIGS. 1 to 3 represent one embodiment of a horizontal type helical compressor as a fluid machinery of a first embodiment of the present invention.

With reference to FIG. 1, the horizontal type helical compressor 1 is provided with an outer cylindrical case or housing 2, in which there are arranged a body of a helical type compressing unit or mechanism 3, an electric drive (motor) unit or mechanism 5 for driving the helical type compressing mechanism 3 through a rotational shaft 4 and a fan 6 mounted to an end portion of the rotational shaft 4, and a cooling passage 7 is also formed in the cylindrical case 2. Further, hereinlater, the horizontal helical type compressor 1 may be called merely compressor 1 and the horizontal helical type compressing mechanism 3 may be called merely helical mechanism 3.

In the illustrated embodiment, the cylindrical case 2 has a circularly cylindrical appearance, for example, and is provided with end openings 2*a* and 2*b* for ventilation at its both axial ends. As mentioned above, since the motor unit 5, the helical mechanism 3 and the fan 6, which are mounted to the rotational shaft 4 in an aligned state in the cylindrical case 2, the compressor 1 can provide a small and compact structure. In this embodiment, the fan 6 is mounted to the end portion (right-hand as viewed) of the rotational shaft 4 on the side of the helical mechanism 3.

The motor unit 5 is composed of a stator 11 press-fitted in the case 2 and a rotor 12 disposed inside the stator and mounted to the rotational shaft 4 to be rotatable together. Thus, the electric motor unit 5 is energized through current conduction, and the rotor 12 is driven to be rotated.

The helical mechanism 3 comprises a horizontally disposed cylinder, i.e. cylinder block, 21, a roller (rotating member) 22 eccentrically disposed in the cylinder 21 and a helical blade 23 interposed between the roller 22 and the cylinder 21 so as to define or section a plurality of compression chambers 24 along the axial direction of the cylinder 21.

As shown with the sectional view of FIG. 2, the cylinder 21 is formed of an aluminium or aluminium alloy or like aluminium including material and is provided, at its outer periphery, with heat radiation fins 21*a* and mount portions 21*b* in form of brackets, which are arranged along the axial direction of the cylinder 21 so as to project outward.

The cylinder 21 has the same outer peripheral shape along its axial direction and is secured to the inner wall of the case 2 through the mount portions 21*b* so as to provide ventilation passages g3 between the outer periphery of the cylinder 21 and the inner wall of the case 2.

The cylinder 21 is closed at its both axial ends by a main bearing 25, at one end, formed with a ventilation through hole 25*a* and by a counter bearing (sub-bearing) 26, at the other one end, formed with a ventilation through hole 26*a*. These main and counter bearings 25 and 26 are fastened by means of bolts 27, for example, to the cylinder 21 as shown in FIG. 1.

The rotational shaft 4 is supported to be rotatable by the main and counter bearings 25 and 26. The rotational shaft 4 is provided with a crank portion 4*a* with which the roller 22 is engaged. Although the crank portion 4*a* has a small eccentricity, since it is very small, the rotational shaft 4 will be deemed to be substantially straight. Balancers 4*b*1 and 4*b*2 are mounted to the crank portion 4*a* of the rotational shaft 4 in an integral manner and these balancers 4*b*1 and 4*b*2 are accommodated in two balancer chambers 22*a* and 22*b* formed to the roller 22 for ensuring and suitably keeping weight balance caused by the rotational motion of the shaft 4. This rotational shaft 4 includes a main shaft portion 4*c* supported by the main bearing 25 and a counter shaft portion 4*d* supported by the counter bearing 26.

The roller 22 is disposed eccentrically inside the cylinder 21 so as to contact the inner peripheral surface of the cylinder 21, and the roller 22 has a portion 22*c* to be engaged with the crank portion 4*a* of the rotational shaft 4 so as to be mounted thereto (this portion being called engagement portion 22*c*, herein). A helical blade groove 28 is formed to the outer peripheral surface of the roller 22. The blade groove 28 has a section in substantially a rectangular shape having groove pitch gradually reduced along the axial direction of the roller 22.

In the blade groove 28 of the roller 22, the helical blade 23 is fitted, and this helical blade 23 is formed from a blade material of an elastic material, plastic material, fluorine contained resin material such as Teflon or fluorine contained plastic material. In the formation of the helical blade, it is preferred to preliminarily impregnate the blade material with oil for improving oil lubrication performance.

The helical blade 23 is accommodated in the blade groove 28 formed to the outer peripheral surface of the roller 22, and in the mounting state, the helical blade 23 is restricted to the inner peripheral wall surface of the cylinder 21 by the eccentric rotational motion of the roller 22 to thereby smoothly fit and slide in the blade groove 28. For the eccentric rotation of the roller 22, an automatic rotation preventing mechanism 29 which permits the revolution of the roller but prohibits the rotation thereof. The automatic rotation preventing mechanism 29 is composed of, for example, an Oldham's ring, which is disposed between the end surface of the roller 22 and the counter bearing 26.

A space between the cylinder 21 and the roller 22 by the helical blade 23 is sectioned by a plurality of compression chambers 24 along the axial direction of the cylinder 21. The respective compression chambers 24 are changed continuously in their volumes so that the inner volumes of the respective compression chambers 24 are reduced towards the main bearing side 25 from the counter bearing side 26, and according to such difference in volumes of the chambers, the cooling medium, as a fluid to be compressed, is compressed.

Furthermore, the cooling medium flowing passage (i.e. cooling passage) 7 formed to the horizontal type helical compressor 1 of the structure mentioned above is composed of a gap g2 formed between the stator 11 of the motor unit and the outer cylindrical case 2 or a gap g1 formed between the stator 11 and the rotor 12 of the motor unit, the ventilation through hole 25*a* formed to the main bearing 25, the balancer accommodation chamber 22*a*, the ventilation through hole 22*d* formed to the engagement portion 22*c* of the roller 22, the other balancer accommodation chamber 22*b* and the ventilation through hole 26*a* formed to the counter bearing 26. The cooling passage 7 also includes the gap g2 and the gap g3 formed between the cylinder 21 and the outer case 2. As mentioned above, the cooling passage 7 and the fan 6 constitutes the air cooling unit of the horizontal type helical compressor 1 of the present invention. Further, in the illustration of the drawings, gas suction port and gas exhaust port are denoted by reference numerals 30 and 31, respectively.

The horizontal type helical compressor of the present invention will operate as follows.

First, when the motor unit 5 is driven through the current conduction, rotating field is caused in the stator 11 of the motor unit 5 and the rotor 12 thereof is then driven to rotate.

The rotation of the rotor 12 is transmitted to the engagement portion 22*c* of the roller through the crank portion 4*a* of the rotational shaft 4, as output shaft, and the roller 22 is thus rotated eccentrically. According to such eccentric rotation of the roller 22, the roller 22 slides and revolves in the cylinder 21 in contact to the inner peripheral surface thereof. In this operation, the compression chambers 24 formed, by the helical blade 23, between the cylinder 21 and the roller 22 move in a helical shape along the axial direction of the cylinder 21 and the inner volumes of the respective chambers 24 are changed so as to be gradually reduced in this axial direction. The cooling medium sucked through the suction port 30 is continuously compressed so as to create high pressure and, thereafter, is exhausted through the exhaust port 31 on the high pressure side compression chamber 24 on the side of the counter bearing 26.

In the cooling medium compression process mentioned above, when the rotational shaft 4 is rotated, the fan 6 mounted to the end portion of thereof is also rotated. The rotation of the fan 6 causes an air flow in the direction shown with arrows in FIG. 1, and this air flow enters in the compressor 1 through the one end opening 2*a* of the case 2, passes through the cooling passage 7 and then is exhausted through the other end opening 2*b* of the case 2.

More especially, the air flow passes the gap g1 to cool the motor unit 5, passes the ventilation through hole 25*a* and enters the balancer chamber 22*a* in which the main bearing 25, the roller 22 and the helical blade 23 are cooled, passes the ventilation through hole 22*d* to cool the roller 22, enters the balancer chamber 22*b*, and passes the counter bearing 26. Thereafter, the air flow reaches the fan 6 and then is exhausted outside the compressor 1.

On the other hand, the air flow passing the gap g2 cools the motor unit 5 and then passes the gap g3 to cool the cylinder 21. During the passing through the gap g3, heat radiation can be effectively performed through the heat radiation fins 21*a* formed to the outer periphery of the cylinder 21 along the axial direction thereof. Furthermore, since the cylinder 21 is formed of an aluminium or aluminium alloy material, such heat radiation effect can be further enhanced, and moreover, since the outer peripheral portion of the cylinder 21 has the same sectional area along its axial direction, the flowing of air cannot be disturbed, so that the cylinder 21 can be effectively cooled.

Figure 4:
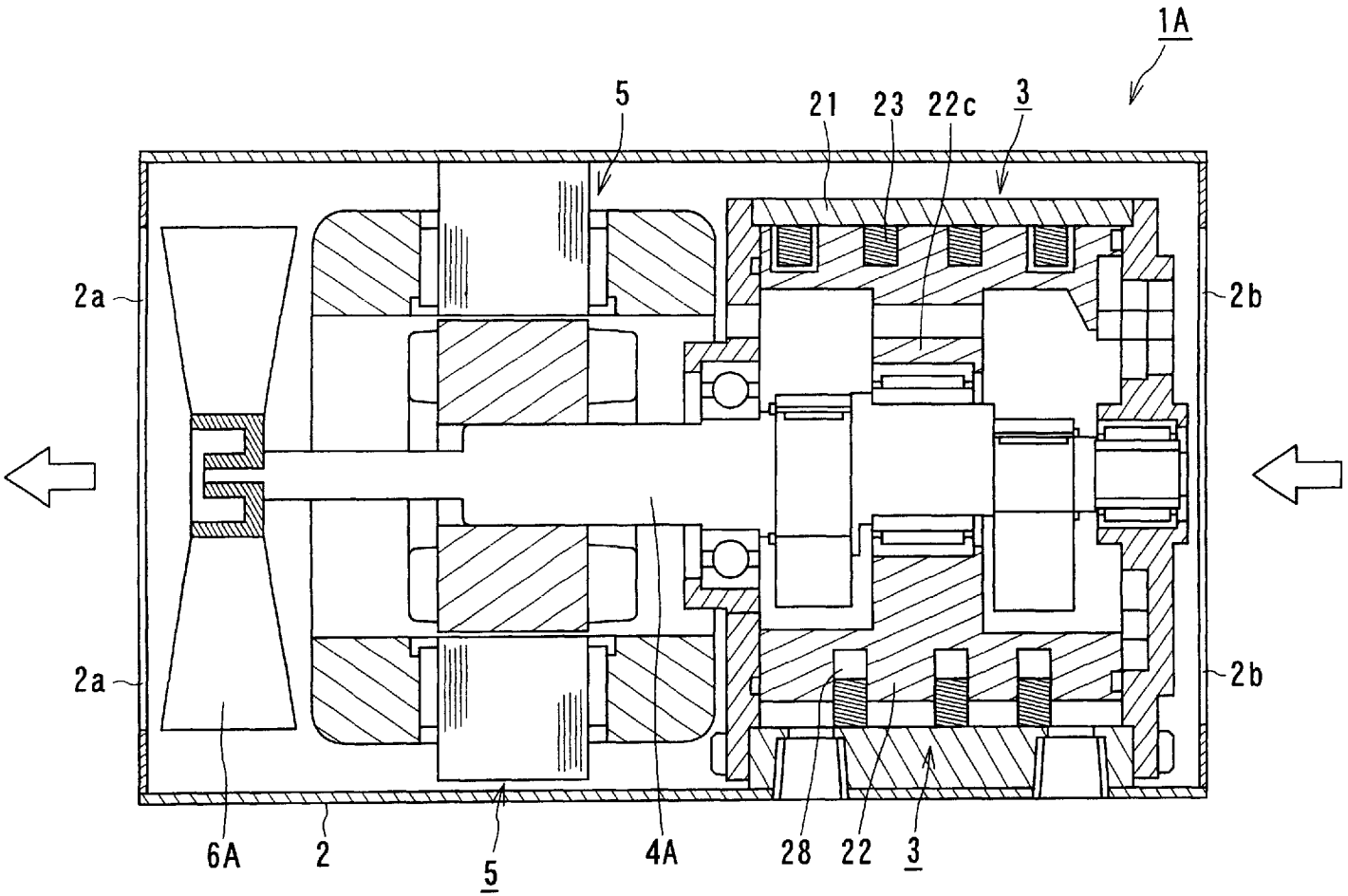
FIG. 4 is a sectional view of a fluid machinery according to a second embodiment, as a modification of the first embodiment, of the present invention, taken along the axial line thereof.

FIG. 4 represents a second embodiment of a fluid machinery, as a modified embodiment of the first embodiment, according to the present invention.

In the fluid machinery 1A of this embodiment, a fan 6A is mounted on the end portion of a rotational shaft 4A on the side of the motor unit 5 (left side as viewed), whereas, in the first embodiment, the fan 6 is mounted on the end portion of the rotational shaft 4A on the side of the helical mechanism 3. The structures of the second embodiment other than the difference in the fan arrangement mentioned above, are substantially the same as those of the first embodiment, so that the details thereof are omitted herein.

The fluid machinery 1A of this second embodiment can achieve substantially the same functions as those of the first embodiment in addition to the improved cooling effect.

Figure 5:
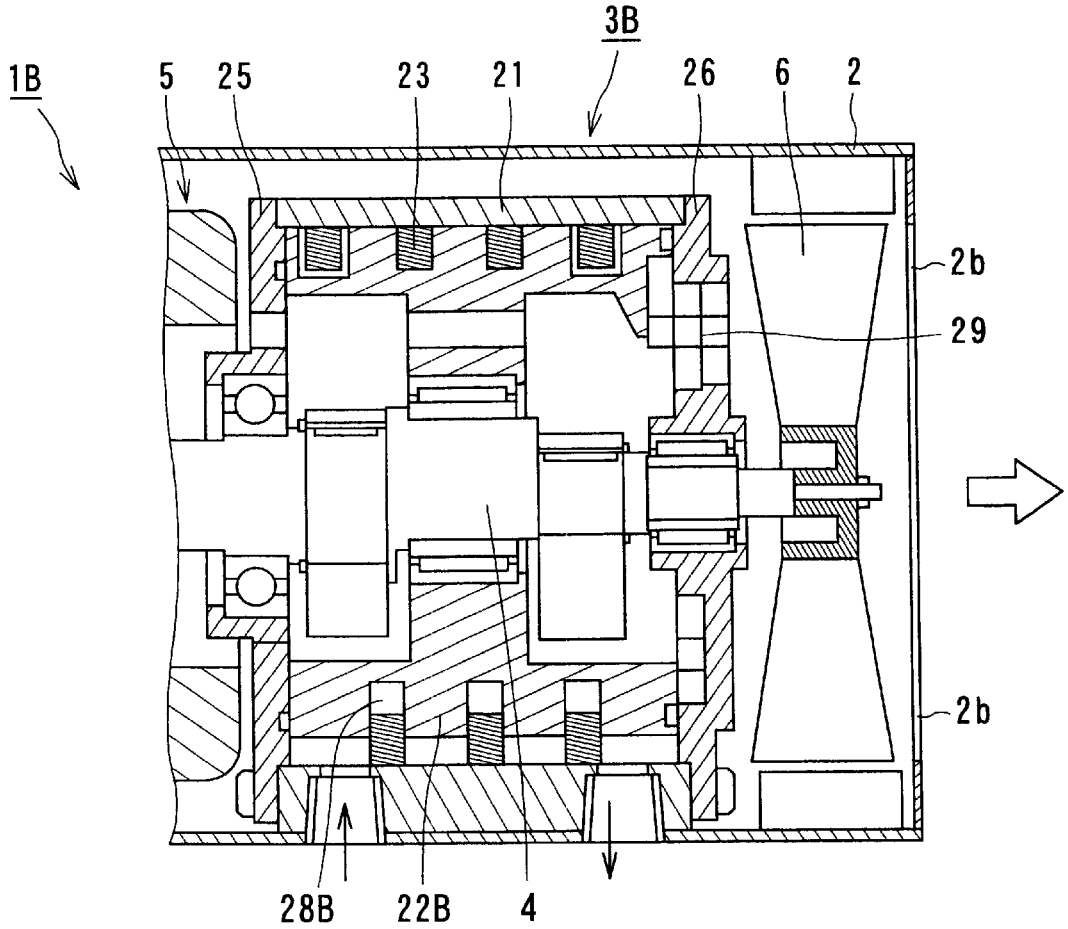
FIG. 5 is a sectional view of a fluid machinery according to a third embodiment, as another modification of the first embodiment, of the present invention, taken along the axial line thereof.

FIG. 5 represents a third embodiment of a fluid machinery, as a modified embodiment of the first embodiment, according to the present invention.

In the embodiments mentioned above, the blade groove 28 has the groove pitch gradually reduced along the axial direction of the roller 22, for example, in the right direction as viewed in FIG. 1, whereas in the fluid machinery 1B of this third embodiment, the groove pitch 28B formed to a roller 22B of a helical mechanism 3B is made substantially equal along the axial direction of the roller 22B.

The fluid machinery 1B of this third embodiment can also achieve substantially the same functions as those of the first embodiment in addition to the improved cooling effect.

It is further to be noted that the present invention is not limited to the described embodiments and many other changes and modifications may be made without departing from the scopes of the appended claims.

For example, in the described embodiments, the fluid machinery is provided with the outer cylindrical case and the air is introduced through the end opening thereof. However, although not shown in the drawings, the air may be introduced into the fluid machinery 1 (1A, 1B) by sucking the air through openings which may be formed to the cylindrical side wall section of the case 2 at portions suitable for introducing the air in front of the arrangement of the main bearing 25.

Furthermore, the present invention may be applied to a structure not provided with the outer case 2, and in such example, when the motor unit is driven and the fan is operated, the air will be introduced inside the fluid machinery from a portion in front of the arrangement of the main bearing 25 and then passes through holes formed to the main and counter bearings and the balancer accommodation chambers, for example. In such examples, the more effective air cooling performance of an oxygen enriched air will be expectable.

What is claimed is:

1. A fluid machinery comprising:

a helical mechanism provided with a cylinder, a roller eccentrically disposed inside the cylinder and formed with a helical groove and a blade member fitted in the helical groove;

an electric motor unit operatively connected to said helical mechanism through a rotational shaft so as to drive the helical mechanism, said roller, which eccentrically rotates, having an engagement portion engaged with a crank portion of the rotational shaft; and a pair of bearings disposed to both axial end portions of said cylinder so as to support the rotational shaft, said engagement portion of the roller and said bearings being formed with through holes for ventilation, respectively.

2. A fluid machinery according to claim 1, further comprising a fan mounted to an end portion of the rotational shaft.

3. A fluid machinery according to claim 2, wherein said fan is disposed on the side of the helical mechanism.

4. A fluid machinery according to claim 2, wherein said fan is disposed on the side of the electric motor unit.

5. A fluid machinery according to claim 1, wherein said cylinder is formed of an aluminium including material.

6. A fluid machinery according to claim 1, wherein said cylinder has an outer periphery to which fluid suction port and fluid exhaust port are formed for the fluid to be delivered by said helical mechanism.

7. A fluid machinery according to claim 1, wherein said cylinder is provided, at an outer periphery thereof, with fins for heat radiation.

8. A fluid machinery according to claim 1, wherein said helical groove has a pitch gradually reduced along an axial direction of the roller.

9. A fluid machinery according to claim 1, wherein said helical groove has a pitch substantially equal along an axial direction of the roller.

10. A fluid machinery according to claim 1, further comprising a cylindrical case into which said helical mechanism and said electric motor unit are accommodated, said cylindrical case being provided with openings for ventilation formed to both axial end portions thereof.

11. A fluid machinery according to claim 10, wherein said cylinder has an outer periphery secured to an inner periphery of said case so as to define a ventilation space therebetween.

12. A fluid machinery according to claim 11, wherein the outer periphery of said cylinder has a cross section of a shape substantially the same along an axial direction thereof.

* * * * *